US009242470B2

(12) United States Patent
Suzuki et al.

(10) Patent No.: US 9,242,470 B2
(45) Date of Patent: Jan. 26, 2016

(54) RECORDING APPARATUS

(75) Inventors: Seiji Suzuki, Ebina (JP); Yuji Kanome, Yokohama (JP); Hiroyuki Tanaka, Kawasaki (JP); Yoshiaki Suzuki, Nagareyama (JP); Masahiro Sugimoto, Yokohama (JP); Susumu Hirosawa, Tokyo (JP); Takeaki Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 260 days.

(21) Appl. No.: 12/946,733

(22) Filed: Nov. 15, 2010

(65) Prior Publication Data

US 2011/0115846 A1 May 19, 2011

(30) Foreign Application Priority Data

Nov. 17, 2009 (JP) ..... 2009-262072

(51) Int. Cl.
*B41J 2/165* (2006.01)

(52) U.S. Cl.
CPC ..... *B41J 2/16532* (2013.01); *B41J 2/16544* (2013.01); *B41J 2/16547* (2013.01); *B41J 2/16585* (2013.01); *B41J 2/16541* (2013.01)

(58) Field of Classification Search
None
See application file for complete search history.

(56) References Cited

U.S. PATENT DOCUMENTS

| | | | | |
|---|---|---|---|---|
| 5,500,660 | A | 3/1996 | Childers | |
| 5,793,390 | A | 8/1998 | Claflin | |
| 5,963,228 | A | 10/1999 | Purwins | |
| 2005/0078144 | A1 | 4/2005 | Yamada | |
| 2007/0222815 | A1* | 9/2007 | Kusakari | 347/29 |
| 2008/0174631 | A1* | 7/2008 | Habashi | 347/30 |
| 2008/0278536 | A1 | 11/2008 | Ha | |
| 2009/0102884 | A1* | 4/2009 | Kawakami | 347/32 |
| 2009/0179954 | A1 | 7/2009 | Silverbrook | |
| 2010/0058576 | A1* | 3/2010 | Osaki | 29/593 |

FOREIGN PATENT DOCUMENTS

| | | | |
|---|---|---|---|
| CN | 1948012 | A | 4/2007 |
| CN | 101229717 | A | 7/2008 |
| EP | 1002649 | A2 | 5/2000 |
| EP | 1568502 | B1 | 1/2007 |
| EP | 1754607 | A2 | 2/2007 |
| JP | 05-201028 | A | 8/1993 |

(Continued)

*Primary Examiner* — Alejandro Valencia
(74) *Attorney, Agent, or Firm* — Canon U.S.A., Inc. IP Division

(57) ABSTRACT

An apparatus includes a recording head arranged so as to oppose a sheet moving in a first direction, in which a plurality of first nozzle chips and a plurality of second nozzle chips each having a nozzle array are arranged as different arrays in a second direction crossing the first direction, and in which the first nozzle chips and the second nozzle chips adjacent to each other are shifted from each other in the second direction, a first suction unit opposed to the first nozzle chips and configured to suction ink from a part of the nozzle arrays included in the first nozzle chips, a second suction unit opposed to the second nozzle chips and configured to suction ink from a part of the nozzle arrays included in the second nozzle chips, a suction holder configured to retain the first suction unit and the second suction unit, and a movement mechanism configured to cause relative movement between the recording head and the suction holder in the second direction, wherein the first suction unit and the second suction unit are shifted from each other in the second direction in correspondence with the shift between the first nozzle chips and the second nozzle chips.

14 Claims, 13 Drawing Sheets

(56) References Cited

FOREIGN PATENT DOCUMENTS

| | | | |
|---|---|---|---|
| JP | 5-201028 | A | 8/1993 |
| JP | 06-270420 | A | 9/1994 |
| JP | 08-281968 | A | 10/1996 |
| JP | 10-044419 | A | 2/1998 |
| JP | 10-181040 | A | 7/1998 |
| JP | 2001-260392 | A | 9/2001 |
| JP | 2005-119024 | A | 5/2005 |
| JP | 2007-118525 | A | 5/2007 |
| JP | 2008-179056 | A | 8/2008 |
| JP | 2008-246728 | A | 10/2008 |

* cited by examiner

RECORDING APPARATUS

BACKGROUND OF THE INVENTION

1. Field of the Invention

The present invention relates to an ink jet type recording apparatus using a line type recording head.

2. Description of the Related Art

In an ink jet type recording apparatus, the ink within the head nozzle may be dried and increased in viscosity to be solidified. Further, paper powder, dust, and bubbles may be mixed with the ink in the nozzle, with the result that the recording quality deteriorates due to defective ink discharge caused by clogging. Thus, the recording heads needs to be cleaned.

Japanese Patent Application Laid-Open No. 5-201028 discusses a cleaning mechanism which forcibly suctions ink out of a recording head for recovery. This cleaning mechanism is equipped with a suction port shorter than the entire nozzle arrays of the recording head, and performs suction on the entire nozzles while moving the suction port in the direction in which the nozzle arrays are formed.

There is known a line type recording head in which a plurality of nozzle chips are regularly arranged in a staggered arrangement. Usually, a predetermined gap is provided between the nozzle chips adjacent to each other in each array of the staggered arrangement. In some cases, this gap has a height different from that of the nozzle surface. For example, as shown in FIGS. 5A and 5B, to protect the electrode, there may be provided a sealing portion 123 consisting of a protrusion protruded beyond the nozzle surface 122. If an attempt is made to apply the suction mechanism illustrated in Japanese Patent Application Laid-Open No. 5-201028 to a recording head of such a structure, the following problem will be involved.

While the suction port is being moved along the nozzle arrays, the suction port is raised when it gets over the sealing portion 123 of a different height. In the direction in which the suction port moves, the position of the sealing portion 123 in a nozzle chip array is that of the nozzle array 121 in the adjacent nozzle chip array. When a portion of the suction port climbs onto the sealing portion 123 of a nozzle chip array, the entire suction port is raised, and the intimate contact between the nozzles of the adjacent nozzle chip array and the suction port becomes rather incomplete, which may lead to defective suction.

SUMMARY OF THE INVENTION

The present invention is directed to a recording apparatus capable of more reliably cleaning the nozzle surface of a line type recording head in which a plurality of nozzle chips are regularly arranged.

According to an aspect of the present invention, an apparatus includes a recording head arranged so as to oppose a sheet moving in a first direction, in which a plurality of first nozzle chips and a plurality of second nozzle chips each having a nozzle array are arranged as different arrays in a second direction crossing the first direction, and in which the first nozzle chips and the second nozzle chips adjacent to each other are shifted from each other in the second direction, a first suction unit opposed to the first nozzle chips and configured to suction ink from a part of the nozzle arrays included in the first nozzle chips, a second suction unit opposed to the second nozzle chips and configured to suction ink from a part of the nozzle arrays included in the second nozzle chips, a suction holder configured to retain the first suction unit and the second suction unit, and a movement mechanism configured to cause relative movement between the recording head and the suction holder in the second direction, wherein the first suction unit and the second suction unit are shifted from each other in the second direction in correspondence with the shift between the first nozzle chips and the second nozzle chips.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
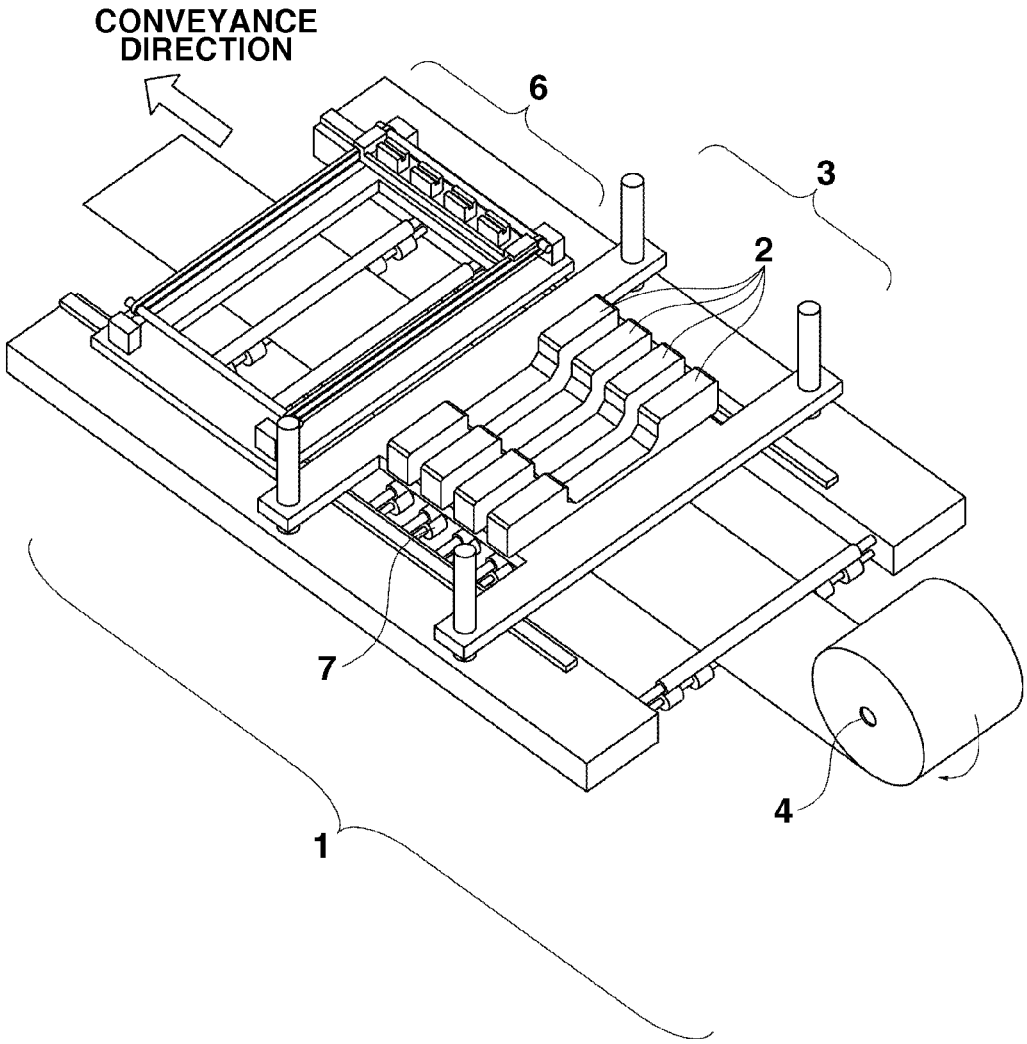
FIG. 1 is a perspective view of a main portion of a recording apparatus according to an exemplary embodiment of the present invention.
Figure 2:
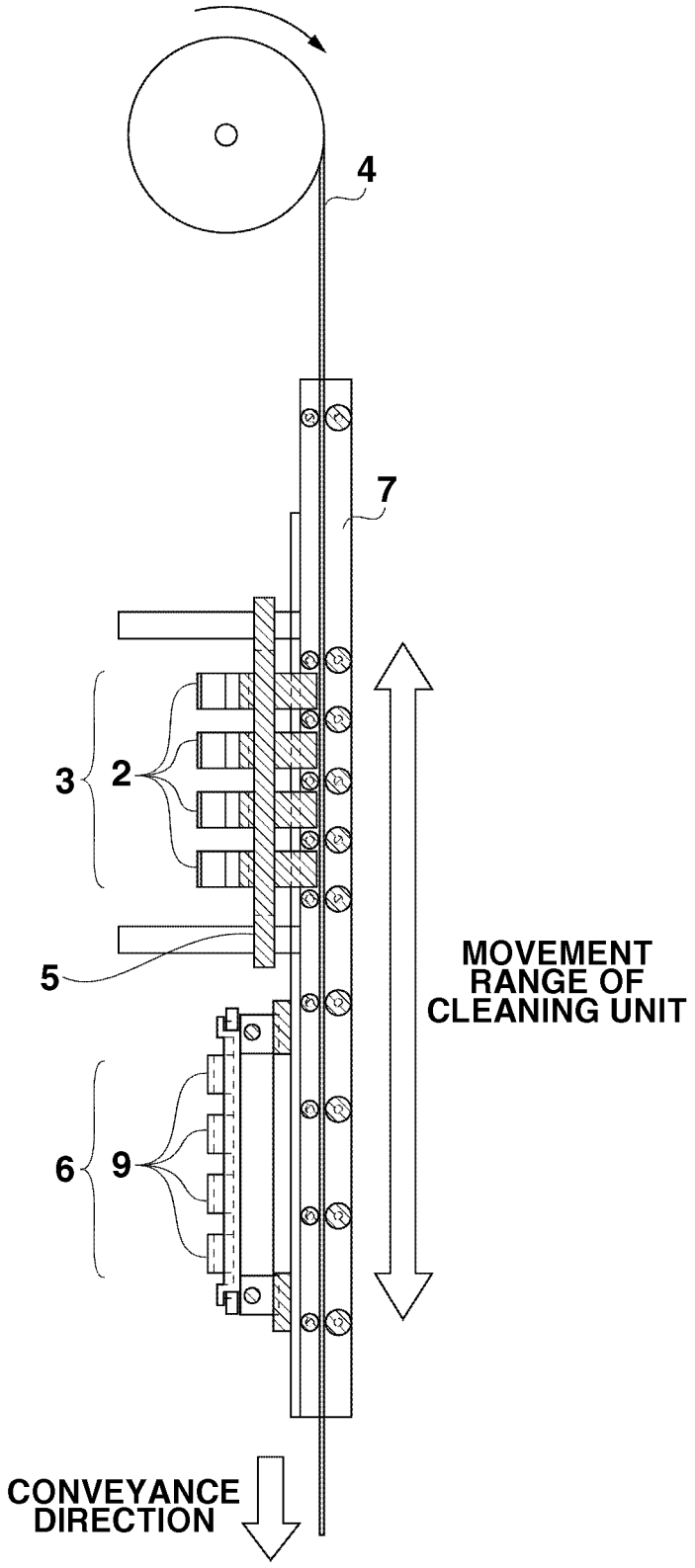
FIG. 2 is a sectional view of the main portion of the recording apparatus.
Figure 3:
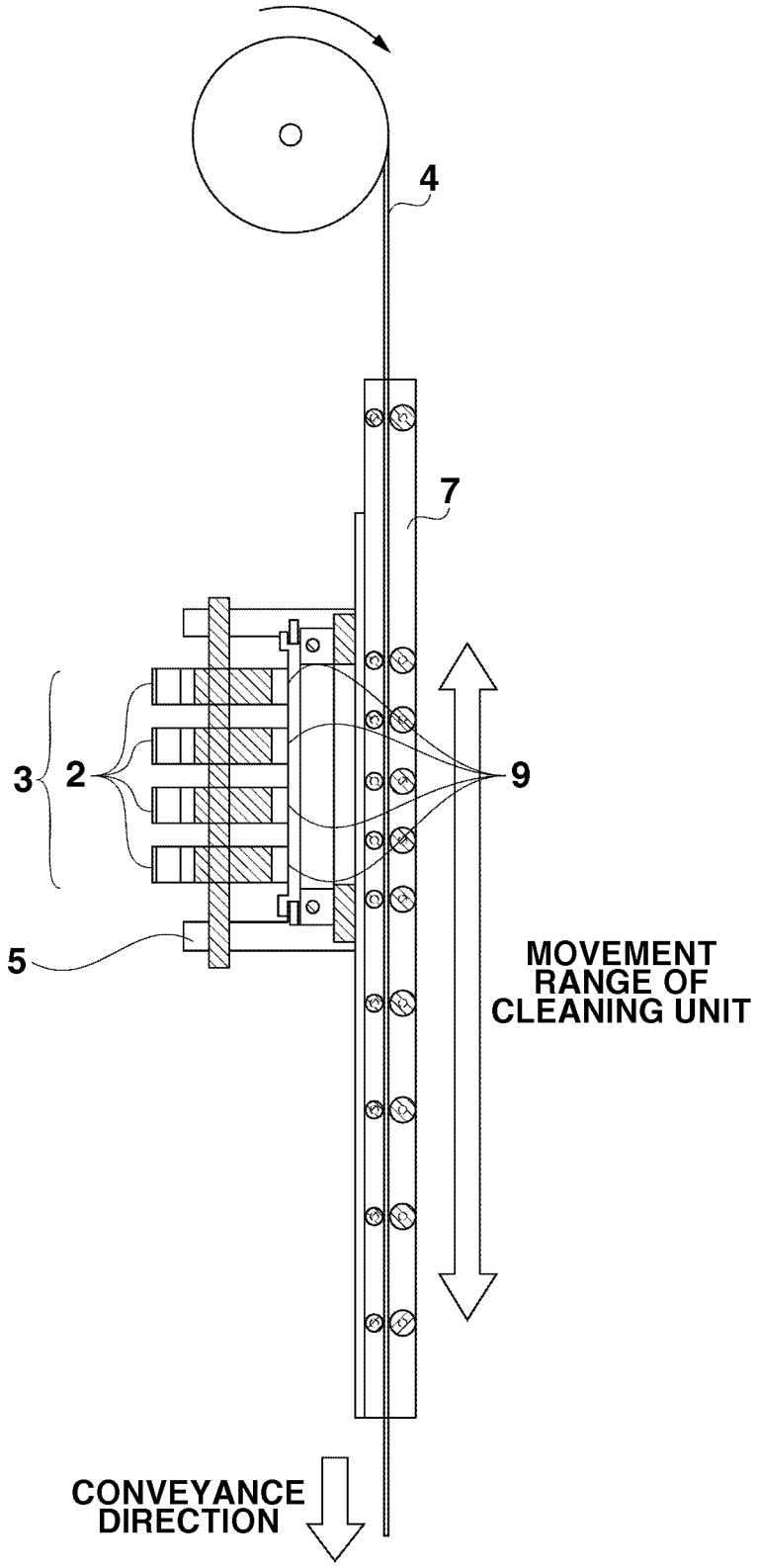
FIG. 3 is a sectional view illustrating the state during cleaning operation.

FIG. 1 is a perspective view illustrating a construction of a main portion, in particular, a recording unit, of a recording apparatus according to an exemplary embodiment of the present invention, and FIG. 2 is a sectional view of FIG. 1. FIG. 3 is a sectional view illustrating the state during cleaning operation.

The recording apparatus of the present exemplary embodiment is a line printer using an elongated line head, which performs printing while continuously conveying a sheet in a conveyance direction (first direction). The recording apparatus is equipped with a holder retaining a sheet 4 such as a continuous paper sheet in the form of a roll, a conveyance mechanism 7 conveying the sheet 4 in the first direction at a predetermined speed, and a recording unit 3 performing recording on the sheet 4 by using line heads. The sheet is not limited to a continuous roll sheet, and may also be a cut sheet. Further, the recording apparatus 1 is equipped with a cleaning unit 6 cleaning the nozzle surface of a recording head through wiping. Further, on the downstream side of the recording unit 3, there are provided, along the sheet conveyance path, a cutter unit cutting the sheet 4, a drying unit forcibly drying the sheet, and a discharge tray.

The recording unit 3 is equipped with a plurality of recording heads 2 respectively corresponding to inks of different colors. Although the present exemplary embodiment employs four recording heads corresponding to the four colors of cyan (C), magenta (M), yellow (Y), and black (K), the number of colors is not limited to four. The inks of the different colors are respectively supplied to the recording heads 2 from ink tanks via ink tubes. The plurality of recording heads 2 are integrally retained by a head holder 5, and there is provided a mechanism allowing the head holder 5 to move vertically so that the distance between the plurality of recording sheets 2 and the surface of the sheet 4 can be varied.

The cleaning unit 6 has a plurality of (four) cleaning mechanisms 9 in correspondence with a plurality of (four) recording heads 2. Each cleaning mechanism 9 will be described in detail below. The cleaning unit 6 as a whole can slide in a first direction. FIGS. 1 and 2 illustrate the state during recording, and the cleaning unit 6 is arranged on the downstream side of the recording unit 3 with respect to the sheet conveyance direction. On the other hand, FIG. 3 shows the operating state during cleaning operation, in which the cleaning unit 6 is positioned directly below the recording heads 2 of the recording unit 3. In FIGS. 2 and 3, the movable range for the cleaning unit 6 is indicated by the white arrows.

Figure 4A:
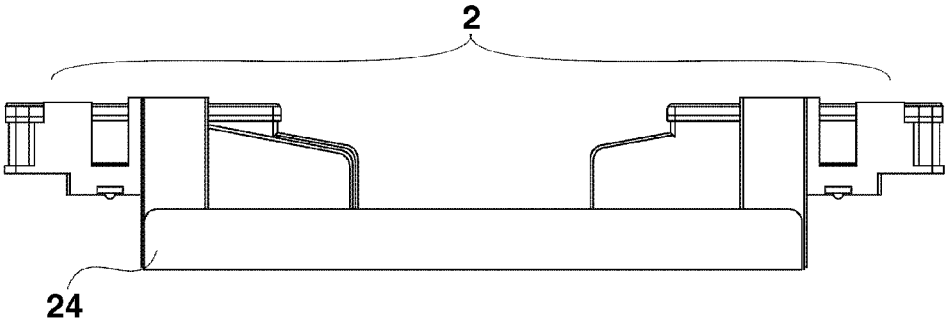
FIGS. 4A and 4B illustrate the structure of a recording head.
Figure 4B:
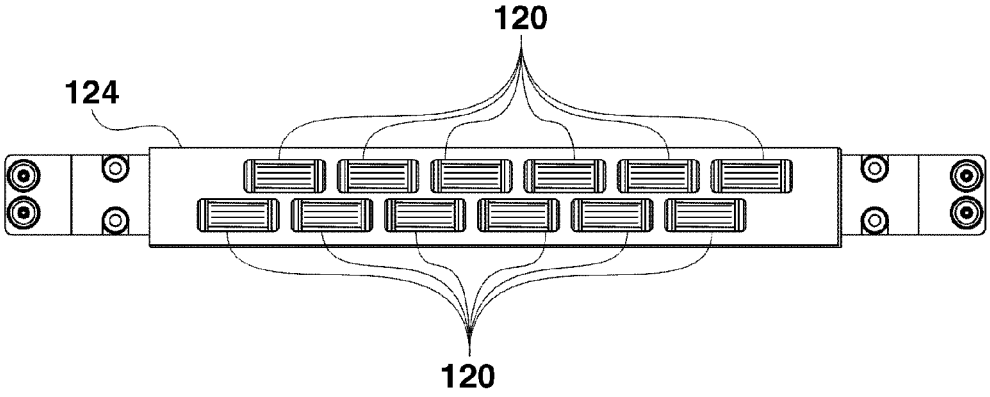

FIGS. 4A and 4B illustrate the structure of one recording head 2. As the ink jet system, it is possible to adopt a system using a heat generating element, a system using a piezoelectric element, a system using an electrostatic element, a system using a micro-electro-mechanical systems (MEMS) element, etc. The recording head 2 is a line type recording head on which ink jet type nozzle arrays are formed over a range covering the maximum width of the sheet of which the use is to be expected. The arrangement direction of the nozzle arrays is a direction (second direction) crossing the first direction, for example, a direction orthogonal thereto. A plurality of nozzle chips 120 are arranged in the second direction on a large base board 124. As illustrated in FIG. 4B, a plurality of (12 in the present exemplary embodiment) nozzle chips 120 of the same size and the same construction are regularly arranged in two arrays in staggered arrangement over the entire area in the width direction. More specifically, on the recording head 2, a plurality of first nozzle chips and a plurality of second nozzle chips, each having nozzle arrays, are arranged as different arrays in the second direction, with the first nozzle chips and the second nozzle chips adjacent to each other being shifted from each other in the second direction. A part of the nozzle arrays included in the first nozzle chips and the second nozzle chips adjacent to each other overlap each other in the second direction.

Figure 5A:
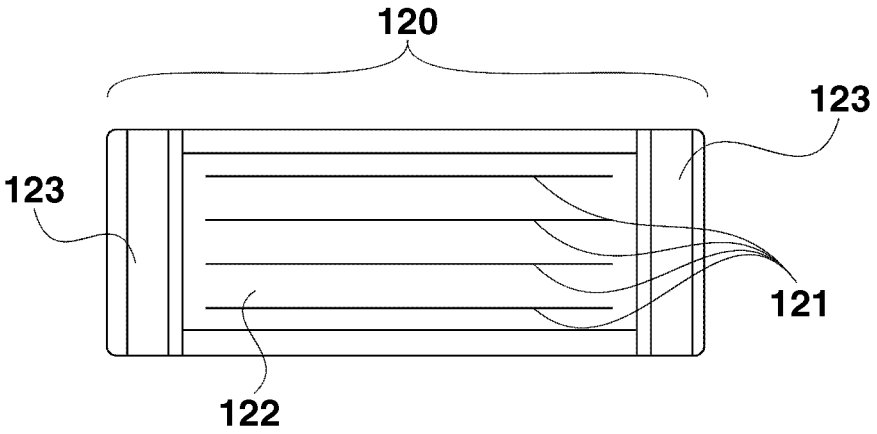
FIGS. 5A and 5B illustrate the structure of a nozzle chip.
Figure 5B:
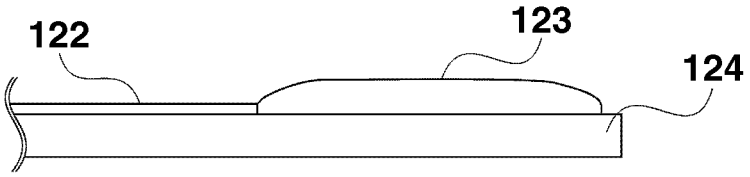

FIGS. 5A and 5B illustrate the structure of one nozzle chip 120 constituting the recording head 2. The nozzle chip 120 is equipped with a nozzle surface 122 having a plurality of nozzle arrays 121 for ejecting ink, and has a nozzle board in which energy elements are embedded in correspondence with the nozzles. A plurality of (four in the present exemplary embodiment) nozzle arrays 121 are arranged in parallel in the first direction. The nozzle board of the nozzle chip 120 is provided on the base board 124. The nozzle board and the base board 124 are electrically connected to each other, and the electrical connection portion is covered with a sealing portion 123 consisting of a resin material so that it may not undergo corrosion or disconnection. As shown in FIG. 5B, when the nozzle surface 122 is seen sideways, the sealing portion 123 is formed on the base board 124, and constitute a protrusion protruding in the ink ejecting direction (referred to as a third direction) beyond the nozzle surface 122. In one nozzle chip 120, the sealing portion 123 is provided in the vicinity of both end portions of the nozzle surface 122 with respect to the direction (second direction) in which the nozzle arrays are formed. In this way, the sealing portions 123 are in proximity to the plurality of nozzle arrays 121 and swollen in the ink ejecting direction beyond the nozzle surface 122 with a gentle step.

Figure 7:
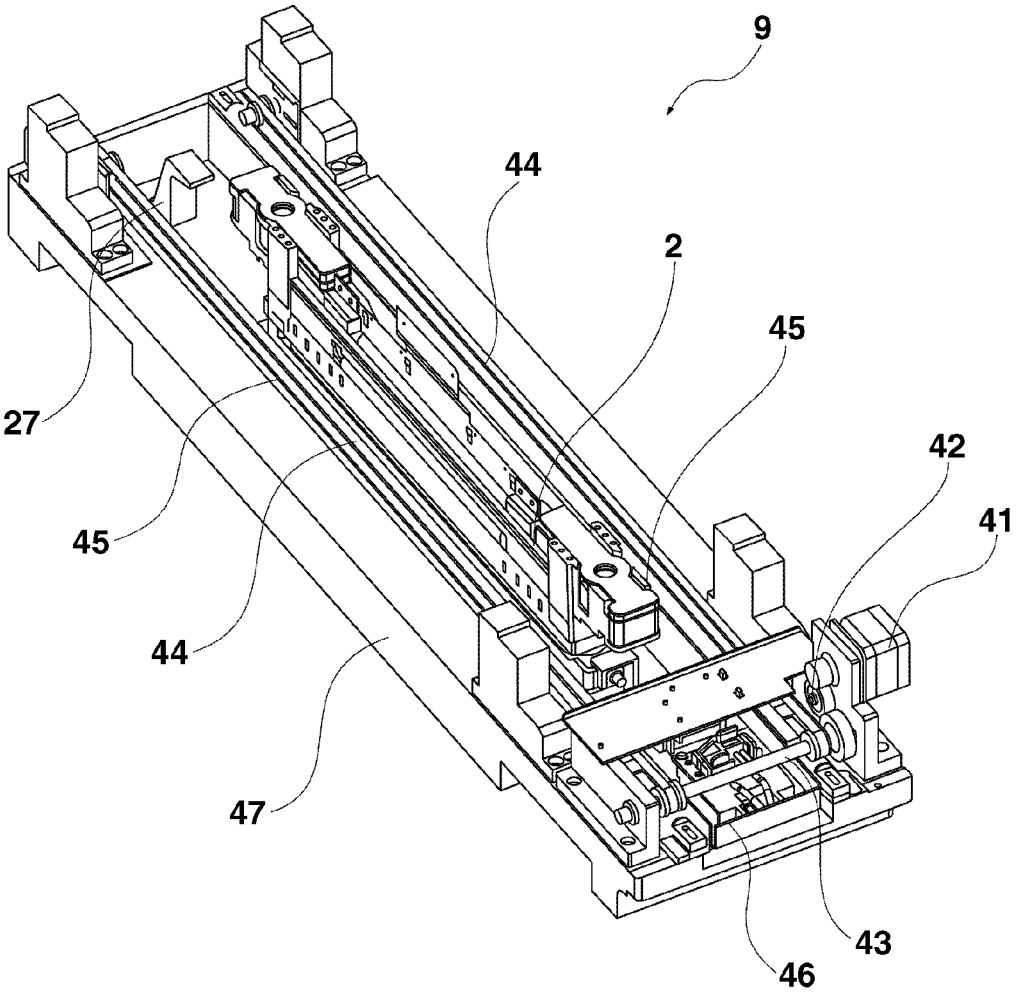
FIG. 7 is a perspective view illustrating the construction of a cleaning mechanism.
Figure 8:
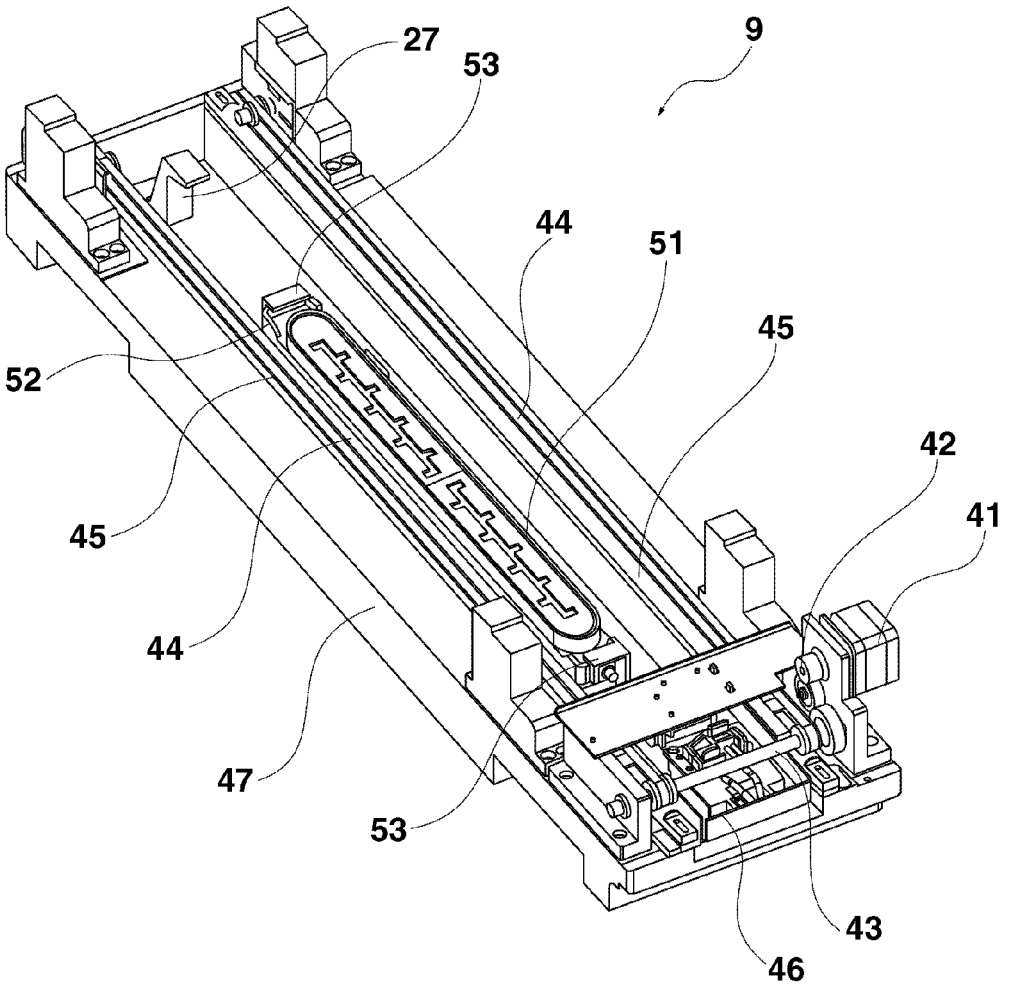
FIG. 8 is a perspective view illustrating the construction of the cleaning mechanism.

FIGS. 7 and 8 are perspective views illustrating in detail a construction of one cleaning mechanism 9. FIG. 7 shows a state (during cleaning operation) in which the cleaning mechanism is under the recording head, and FIG. 8 shows a state (at the time of capping) in which the cleaning mechanism is not under the recording head.

Roughly speaking, the cleaning mechanism 9 has a wiper unit 46 for wiping off ink and dust adhering to the nozzle surface of the recording head 2, a movement mechanism moving the wiper unit 46 in the wiping direction (second direction), and a frame 47 supporting them integrally. The wiper unit 46 includes wiper blades and suction ports described below, which are formed into one movable unit. The movement unit moves the wiper unit 46, guided and supported by two shafts 45, in the second direction. A drive source has a drive motor 41 and speed reduction gears 42 and 43, and rotates a drive shaft 37. The rotation of the drive shaft 37 is transmitted by belts 44 and pulleys to move the wiper unit 46. As described below, the wiper unit 46 removes ink and dust on the nozzle surface of the recording head 2 through a combination of blades and suction ports. Outside the wiping region of the frame 47, there is provided a trigger lever 27 for switching the orientation of blades 21 described below.

In FIG. 8, a cap 51 is retained by a cap holder 52. The cap holder 52 is urged by a spring consisting of an elastic member in a direction perpendicular to the nozzle surface of the recording head 2, and is movable against the spring force. With the frame 47 being in the capping position, the recording head 2 moves perpendicularly with respect to the nozzle surface to be brought into intimate contact with and separated from the cap 51. By capping the nozzle surface through intimate contact, drying of the nozzles is suppressed.

Figure 9:
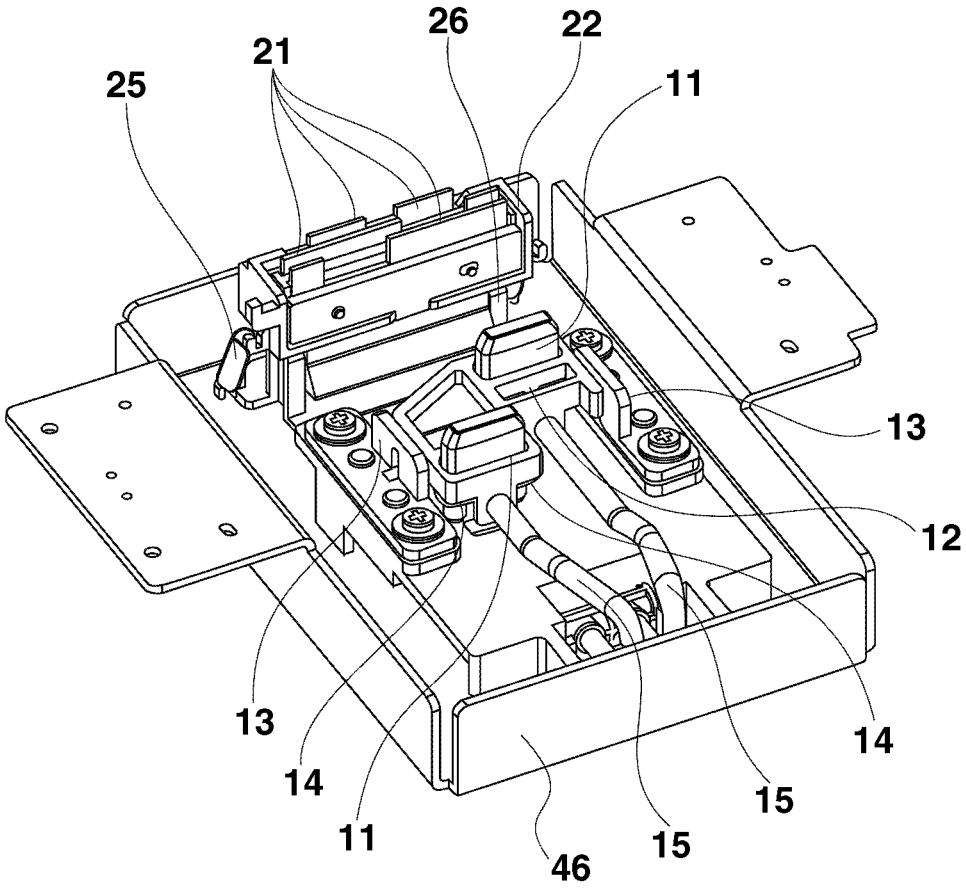
FIG. 9 illustrates the construction of a wiper unit.

FIG. 9 illustrates the construction of the wiper unit 46. Two suction ports 11 (first and second suction units) are provided in correspondence with the first and second nozzle chip arrays. In the first direction, the distance between the two suction ports 11 is the same as the distance between the two nozzle chip arrays. In the second direction, the two suction ports 11 exhibit a shift amount equal to or substantially equal to the shift amount (predetermined distance) between the adjacent nozzle chips of the two nozzle chip arrays. The suction ports 11 are retained by a suction holder 12, and the suction holder 12 is urged in a direction (third direction) perpendicular to the nozzle surface of the recording head 2 by springs 14 consisting of elastic members so as to be movable in the third direction against the spring force. Further, both ends in the first direction of the suction holder 12 are pivoted, and are rotatable around rotation axes in the first direction against the urging force of the springs 14. That is, the suction holder 12 is supported by a displacement mechanism with an elastic member so as to be capable of both straight-ahead displacement in the direction (third direction) between the nozzle surface and the sheet and tilt displacement with respect to the nozzle surface whose rotation axis is in the first direction. This displacement mechanism serves to absorb the movement when the moving suction ports 11 get over the sealing portion 123. This will be described in detail below.

Tubes 15 are connected to the two suction ports 11 via the suction holder 12, and a negative pressure generation unit such as a suction pump is connected to the tubes 15. When the negative pressure generation unit is operated, a negative pressure for suctioning off ink and dust is imparted to the interior of the suction ports 11. Four blades 21 in total, two on the right-hand side and two on the left-hand side, are retained by a blade holder 22. Both ends in the first direction of the blade holder 22 are pivoted, and are rotatable around a rotation axis in the first direction, and usually, the blade holder 22 is urged against a stopper 26 by a spring 25. The blades 21 allow switching of the orientation of the blade surfaces between wiping positions and retracted positions through operation of a switching mechanism described below. The suction holder 12 and the blade holder 22 are arranged on a common support body of the wiper unit 46.

Figure 6:
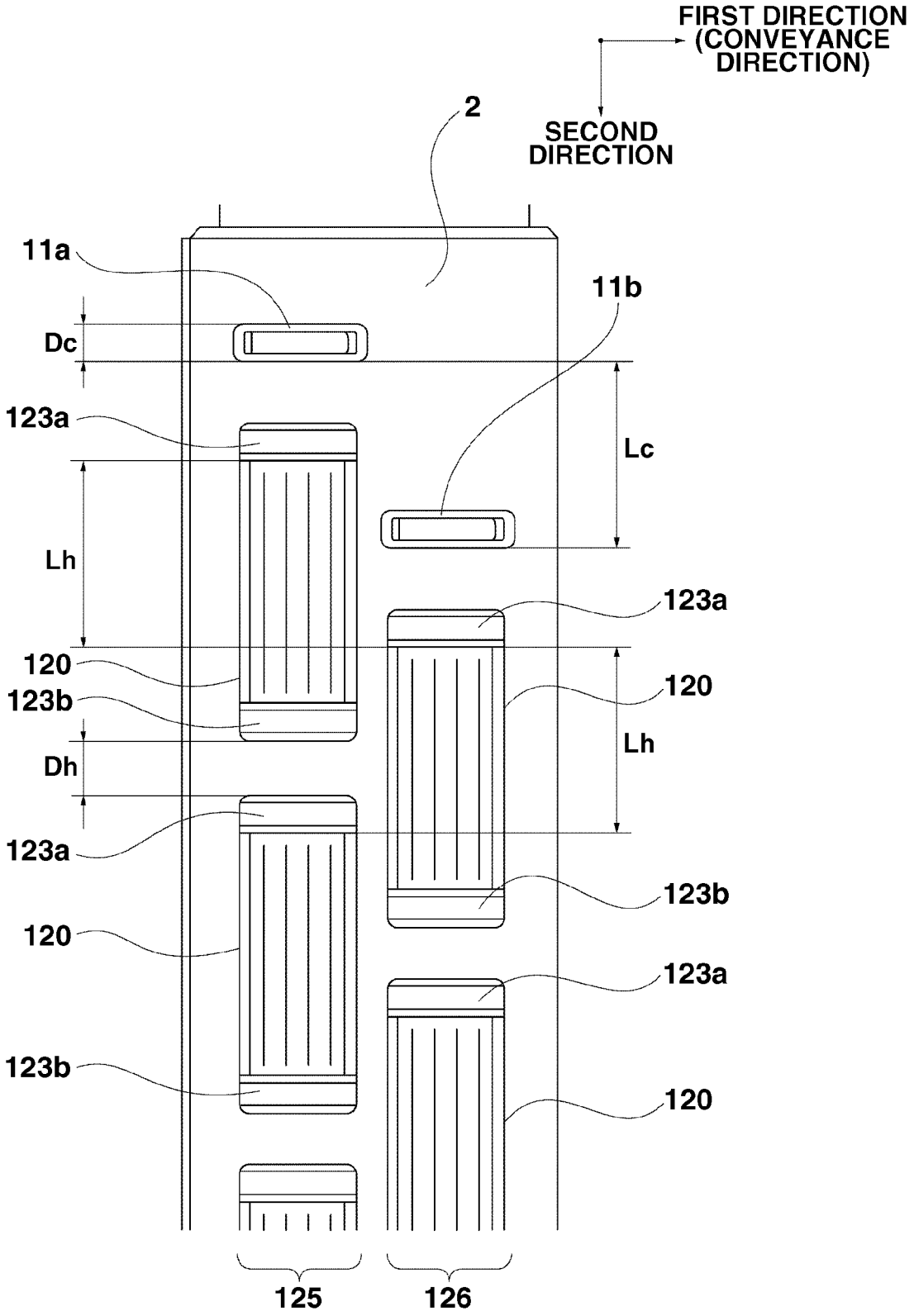
FIG. 6 is a partial enlarged view illustrating the positional relationship between nozzle chips and suction ports.

FIG. 6 is an enlarged partial view illustrating a positional relationship between the nozzle chips 120 and the suction ports 11 of the recording head. In the staggered arrangement of two arrays, a nozzle chip 120 and another nozzle chip 120 adjacent to that nozzle chip 120 in the adjacent array are arranged so as to be spaced apart from each other by a predetermined distance Lh in the second direction. On the other hand, the two suction ports 11 consist of a first suction port 11*a* corresponding to a first nozzle chip array 125 and a second suction port 11*b* corresponding to a second nozzle chip array 126. In the first direction, the first suction port 11*a* and the second suction port 11*b* are arranged so as to be spaced apart from each other by a distance (inter-center distance) between the first nozzle chip array 125 and the second nozzle chip array 126. Further, the first suction port 11*a* and the second suction port 11*b* are arranged in such a manner that the openings of the suction ports are positioned within a range covering the plurality of nozzle arrays included in the nozzle chips 120 corresponding thereto in the first direction. The first suction port 11*a* and the second suction port 11*b* are shifted from each other in the second direction by a distance Lc. Here, in the second direction, the shift distance Lh of the nozzle chips 120 and the shift distance Lc of the suction ports are equal to each other. Here, the meaning of the adjective "equal" is not limited to the meaning of "strictly identical with each other" but also covers a case where they are substantially equal to each other. In the present invention, the expression, "equal to each other" also means "substantially equal to each other." Here, when it is said that they are substantially equal to each other, it means that there exists a moment at which the first suction port 11*a* and the second suction port 11*b* respectively and simultaneously abut the sealing portion 123*a* and the sealing portion 123*b*. In other words, the shift distance Lh and the shift distance Lc are equal to each other to a degree that the two suction ports always simultaneously abut the sealing portions of the corresponding nozzle chips. In this way, the first suction unit and the second suction unit are shifted from each other in the second direction in correspondence with the shift between the first nozzle chip and the second nozzle chip that are adjacent to each other and in different arrays.

In the second direction, both the first suction port 11*a* and the second suction port 11*b* have a width Dc. In the second direction, the width Dc covers a part of the nozzle arrays, which is a width corresponding to several to several tens of nozzles. In each array in the second direction of the recording head 2, the distance between the adjacent nozzle chips of the same array (the first nozzle chip and the second nozzle chip) 120 (the distance between the end portions of the sealing portions) is Dh. Here, the width Dc and the distance Dh satisfy the relationship: Dc<Dh. By satisfying this positional relationship, it is possible to reduce the distance between the adjacent suction ports 11 and to suppress an increase in the distance between the nozzle chips in the first direction, thereby making it possible to suppress an increase in the size of the apparatus.

Figure 10A:
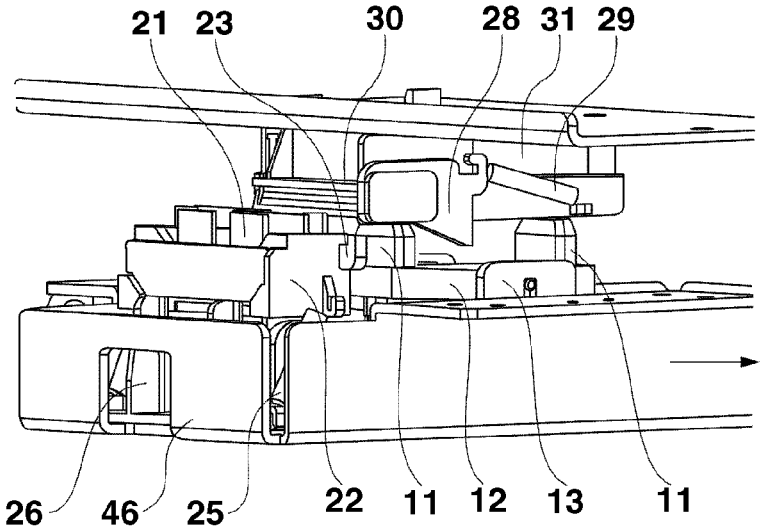
FIGS. 10A, 10B, and 10C are perspective views illustrating a blade position switching operation.
Figure 10B:
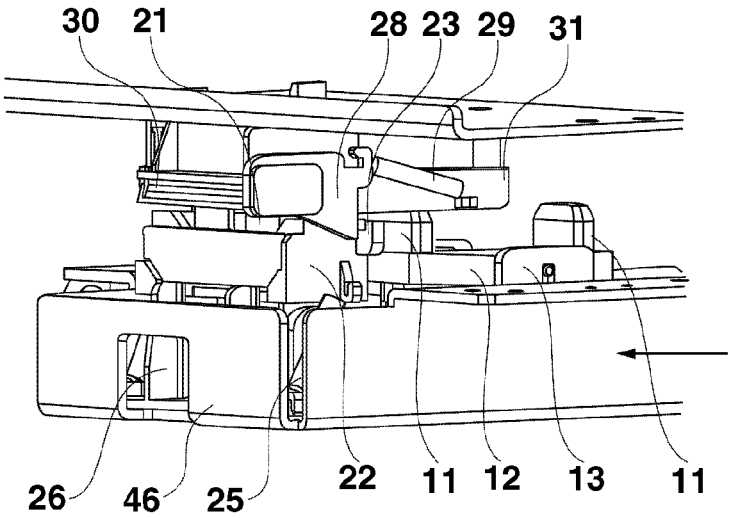
Figure 10C:
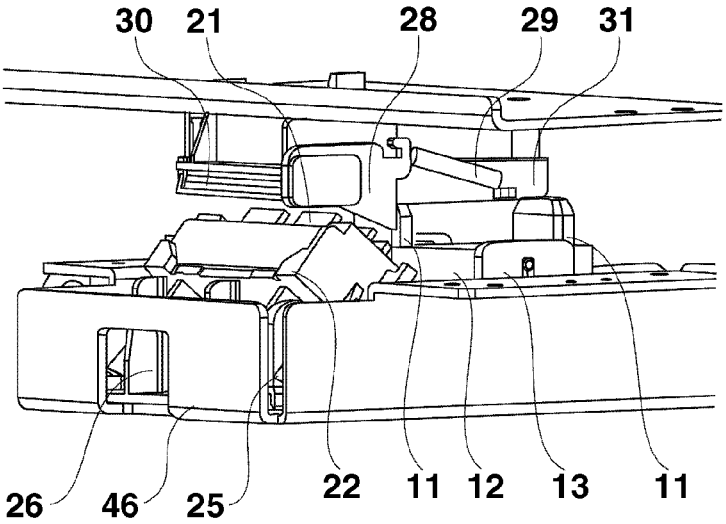

Next, the operation of switching the blade 21 from a wiping position to a retracted position will be described with reference to FIGS. 10A, 10B, and 10C. In FIGS. 10A through 10C, there is provided a cleaner holder 31 at a position opposed to the wiper unit 46 outside the wiping region. Retained by the cleaner holder 31 is a blade cleaner 30 for scraping off ink adhering to the blade 21 when wiping is performed on the recording head 2. A release lever 28 is rotatably supported by the cleaner holder 31 while urged by tension of a spring 29. The release lever 28 is provided at a position where it can abut an abutment portion 23.

FIG. 10A shows a state of the blade 21 at the time of wiping of the nozzle surface. The blade holder 22 is oriented in a usual way, and the blade 21 is oriented in such a manner that the blade surface is perpendicular to the nozzle surface of the recording head 2 (wiping position). In this condition, the forward end portion of the blade 21 is nearer to the nozzle surface of the recording head 2 than the forward end portion of the suction port 11. Here, when the wiper unit 46 moves in the direction of the arrow in FIG. 10A, the blade 21 comes into contact with the blade cleaner 30, and ink and dust adhering to the blade 21 are wiped off by the blade cleaner 30. In the course of this operation, the abutment portion 23 of the wiper unit 46 abuts the slope of the release lever 28, and the slope of the release lever 28 is pressed by the abutment portion 23 to gradually rotate against the urging force of the spring 29. When the abutment portion 23 has passed the slope of the release lever 28, the release lever 28 is restored to the former state by the urging of the spring 29.

FIG. 10B shows the state in which the cleaning by the blade 21 has been completed. Here, when the wiper unit 46 moves in the direction of the arrow of FIG. 10B, the abutment portion 23 abuts an end surface of the release lever 28. If the release lever 28 is pushed from this direction, the release lever 28 does not rotate since it is fixed in position by a lock portion of the cleaner holder 31. Thus, the abutment portion 23 is pressed by the release lever 28, and the blade holder 22 rotates in a direction opposite to the advancing direction of the wiper unit 46 against the urging due to the tension of the spring 25. When the rotation is completed, the tensile force of the spring 25 functions as a force to maintain the state brought about by the rotation.

FIG. 10C illustrates the condition resulting from the rotation of the blade holder 22. The blade holder 22 is inclined, and the blade surface of the blade 21 is oriented so as to be inclined with respect to the nozzle surface of the recording head 2 (retracted position). In this state, the forward end portion of the blade 21 is further spaced apart from the nozzle surface than in the wiping position mentioned above, and is not in contact with the nozzle surface. That is, in the third direction, the forward end portion (the portion of the suction unit nearest to the nozzle surface) of the suction port 11 is arranged between the position of the forward end portion of the blade in the wiping position and the position of the forward end portion of the blade in the retracted position.

Figure 11A:
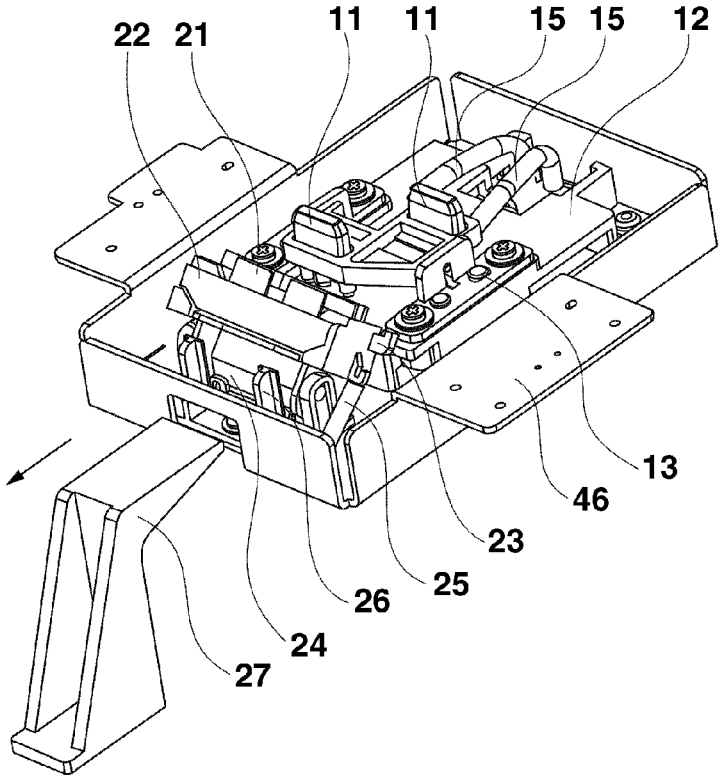
FIGS. 11A and 11B are perspective views illustrating the blade position switching operation.
Figure 11B:
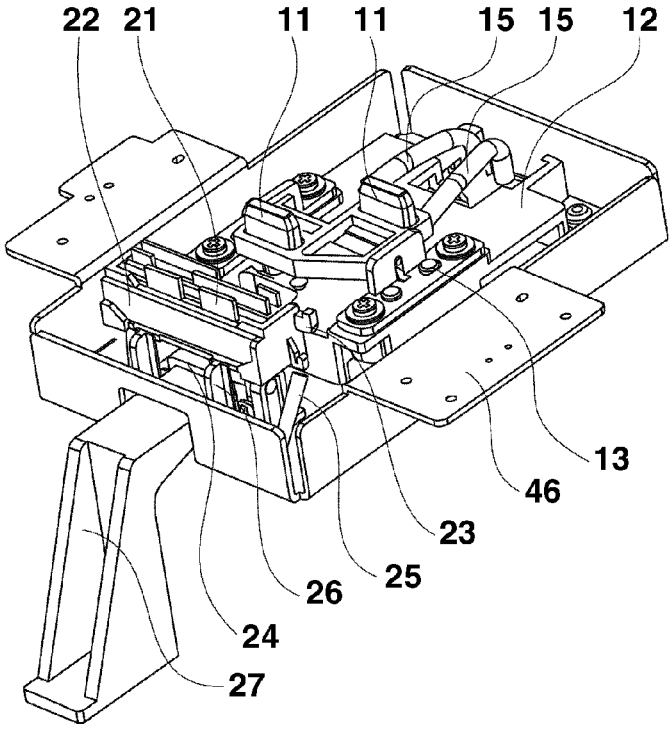

The operation of switching the blade from the retracted position to the wiping position will be described with reference to FIGS. 11A and 11B. In the state of FIG. 11A, in which the blade 21 is in the retracted position, the wiper unit 46 moves in the direction of the arrow. The abutment portion 23 of the blade holder 22 abuts the forward end portion of the trigger lever 27 firmly provided on the frame 47. When it further moves, the blade holder 22 is pressed by the trigger lever 27 to be thereby rotated, and the blade 21 is switched to the wiping position illustrated in FIG. 11B, with which the switching is completed.

Figure 12A:
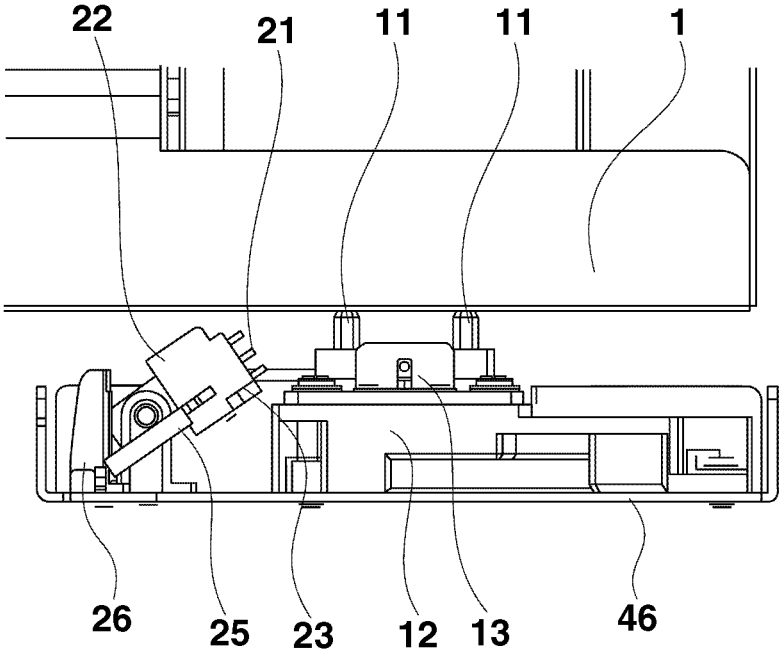
FIGS. 12A and 12B are perspective views illustrating the operation of the cleaning mechanism.
Figure 12B:
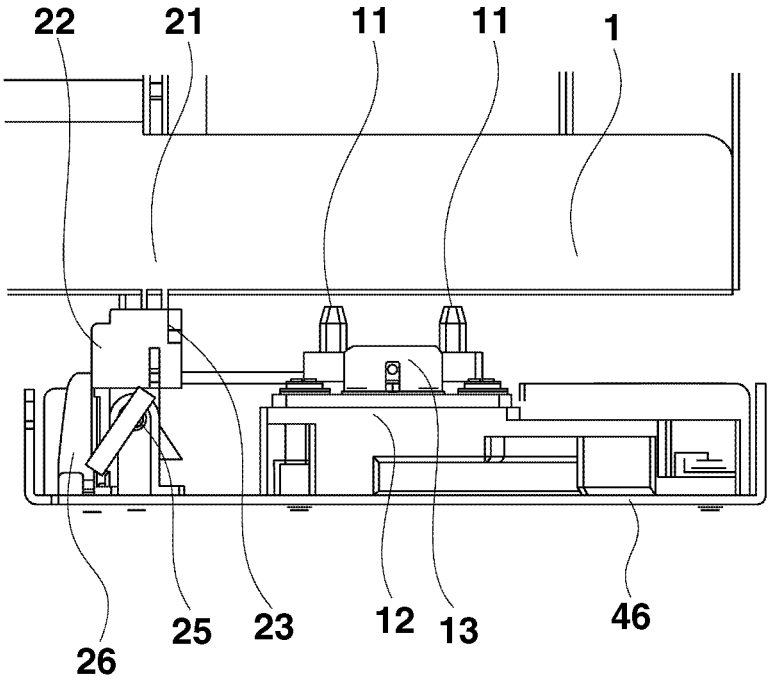

FIGS. 12A and 12B are side views illustrating the operation of the cleaning mechanism. FIG. 12A illustrates a suction mode, in which cleaning is performed on the recording head 2 by the suction ports 11. FIG. 12B illustrates a wiping mode, in which cleaning is performed on the recording head 2 by the blade 21.

As illustrated in FIG. 12A, in the suction mode, the blade 21 is set to the retracted position. The position of the recording head 2 in the third direction is set and maintained in such a manner that the forward end portions of the suction ports 11 are in contact with the nozzle surface of the recording head 2. When the wiper unit 46 is moved in the second direction while generating negative pressure within the suction ports 11 by a negative pressure generation unit, it is possible to suction and remove ink and dust adhering to the nozzles from the suction ports 11. While the wiper unit 46 is being moved in the second direction, the suction ports 11 are pressed in the third direction by the sealing portions 123 protruding from the recording head 2 beyond the nozzle surface. As described above, in the wiper unit 46, the suction holder 12 can be displaced so as to escape with respect to the nozzle surface (third direction), so that even if the suction ports 11 are pressed, it is possible for the movement to be allowed to escape through displacement of the suction holder 12. During suction cleaning, it is not indispensable to bring the suction ports 11 into contact with the nozzle surface. It is also possible to effect suction by imparting negative pressure, with the suction ports brought very close to the nozzle surface without being brought into contact therewith. That is, in the suction mode, the suction ports 11 are brought into proximity to (or contact with) the nozzle surface.

As illustrated in FIG. 6, the distance Lh and the distance Lc are equal to each other, so that the first suction port 11*a* and the second suction port 11*b* are respectively opposed to the sealing portions 123 of the corresponding nozzle chips 120 simultaneously. After this, the first suction port 11*a* and the second suction port 11*b* are simultaneously opposed to the nozzle arrays included in the first and second nozzle chips 120. When the suction ports 11 climbs onto the steps of the sealing portions 123, a force tilting the suction ports 11 is applied to the suction holder 12 via the suction ports 11 to cause inclination. While the suction ports are climbing onto the sealing portions, the suction ports 11 are pressed in the third direction to be displaced. The first suction port 11*a* and the second suction port 11*b* climb onto the sealing portions 123 of the respective arrays substantially simultaneously, so that the suction holder 12 is tilted by the two suction ports substantially simultaneously. The first suction port 11*a* and the second suction port 11*b* are pushed in the third direction also substantially simultaneously. Thus, while the first suction port 11 and the second suction port 11*b* are performing nozzle suction, there is no fear of the suction holder 12 being inclined or pushed in to make the suction rather unstable. For the above reasons, it is possible to achieve an improvement in terms of nozzle cleaning reliability.

In the suction mode, the wiper unit 46 is reciprocated in the second direction by a movement mechanism, and the negative pressure generation unit is controlled in such a manner that the negative pressure imparted to the interior of the suction ports 11, that is, the suction force, is different between the forward movement and the backward movement. More specifically, the negative pressure is larger in the forward movement than in the backward movement. Further, in the suction mode, the wiper unit 46 reciprocates in the second direction, with the movement speed being different between the forward movement and the backward movement. More specifically, the speed is lower in the forward movement than in the backward movement. When effecting suction through reciprocation, most of the ink and dust are absorbed in the first, forward movement, and only a small amount of remaining ink and dust is removed in the next, backward movement. Thus, in the forward movement, in which more ink is absorbed, the negative pressure is increased and the movement speed is reduced for slower movement as compared with the backward movement, whereby suction in a large amount is performed more reliably in the first operation. In the backward movement, the negative pressure is reduced and the speed is increased, whereby it is possible to reduce the power consumption and operational noise and to shorten the total time for the reciprocating operation.

On the other hand, as illustrated in FIG. 12B, in the wiping mode, the blade 21 is switched to the wiping position. The position of the recording head 2 in the third direction is set and maintained in such a manner that the forward end portion of the blade 21 and the nozzle surface of the recording head 2 are properly brought into contact with each other. At this time, the forward end portions of the suction ports 11 and the nozzle surface of the recording head 2 are more spaced apart from each other than in the state as illustrated in FIG. 12A. The negative pressure generation unit stops. When the wiper unit 46 is moved in the second direction, the nozzle surface is wiped by the blade 21, thereby making it possible to remove ink and dust through wiping.

As described above, the cleaning mechanism has the two modes of the suction mode and the wiping mode, and it is possible to selectively execute either of the modes with the same wiper unit 46. For example, the ink ejection state of the nozzles is judged, and, according to the judgment result, the proper mode is selected. More specifically, when the judgment result indicates that there is no non-ejection nozzle, the wiping mode is selected. Wiping is performed on the nozzle surface and the base board 124 by the blade 21, removing ink and dust through wiping. As a result, it is possible to perform cleaning on the nozzle surface without consuming any ink from the nozzles. When the judgment result indicates the presence of a non-ejection nozzle, the suction mode is selected. Ink and dust adhering to the nozzle surface and the nozzles are suctions off by the suction ports 11. As a result, it is possible to perform cleaning while suppressing the consumption of the ink from the nozzles.

When a large amount of recording is performed continuously on the sheets, there is the possibility of a lot of ink and dust adhering to the nozzle surface and the base board 124. In this case, the suction mode is executed after the execution of the wiping mode. Through the wiping mode, the ink and dust on the nozzle surface and the base board 124 are removed through wiping, and then the ink and dust adhering to the nozzle surface and the nozzles are suctioned in the suction mode. As a result, it is possible to shorten the total cleaning time, and to execute cleaning while suppressing the consumption of the ink from the nozzles.

While, in the above exemplary embodiment, the suction unit performs suction through negative pressure, however, this should not be construed restrictively. For example, it is also possible to adopt a suction unit performing suction by using an ink absorbing member instead of negative pressure. At the same positions as the first suction port 11*a* and the second suction port 11*b* illustrated in FIG. 6, there are positioned contact portions of a first ink absorbing member and of a second ink absorbing member. By using a material of high water absorptivity such as a porous material for the ink absorbing members, it is possible to perform suction of more ink per unit time. Since the distance Lh and the distance Lc are equal to each other, the contact portions of the first ink absorbing member and of the second ink absorbing member are simultaneously opposed to the sealing portions 123 of the corresponding nozzle chips 120. After this, the first ink absorbing member and the second ink absorbing member are also simultaneously opposed to the nozzle arrays included in the first and second nozzle chips 120. Thus, in the suction mode, the nozzles are improved in terms of cleaning reliability.

While, in the above exemplary embodiment, the nozzle chips 120 are arranged in staggered arrangement in two arrays, it is also possible to arrange them in some other regular fashion. In any case, in the recording head 2, a plurality of first nozzle chips and a plurality of second nozzle chips each having nozzle arrays are arranged in the second direction as different arrays, and the first nozzle chips and the second nozzle chips adjacent to each other are shifted from each other in the second direction. And, a part of the nozzle arrays included in the first nozzle chips and the second nozzle chips adjacent to each other overlap each other in the second direction.

Figure 13:
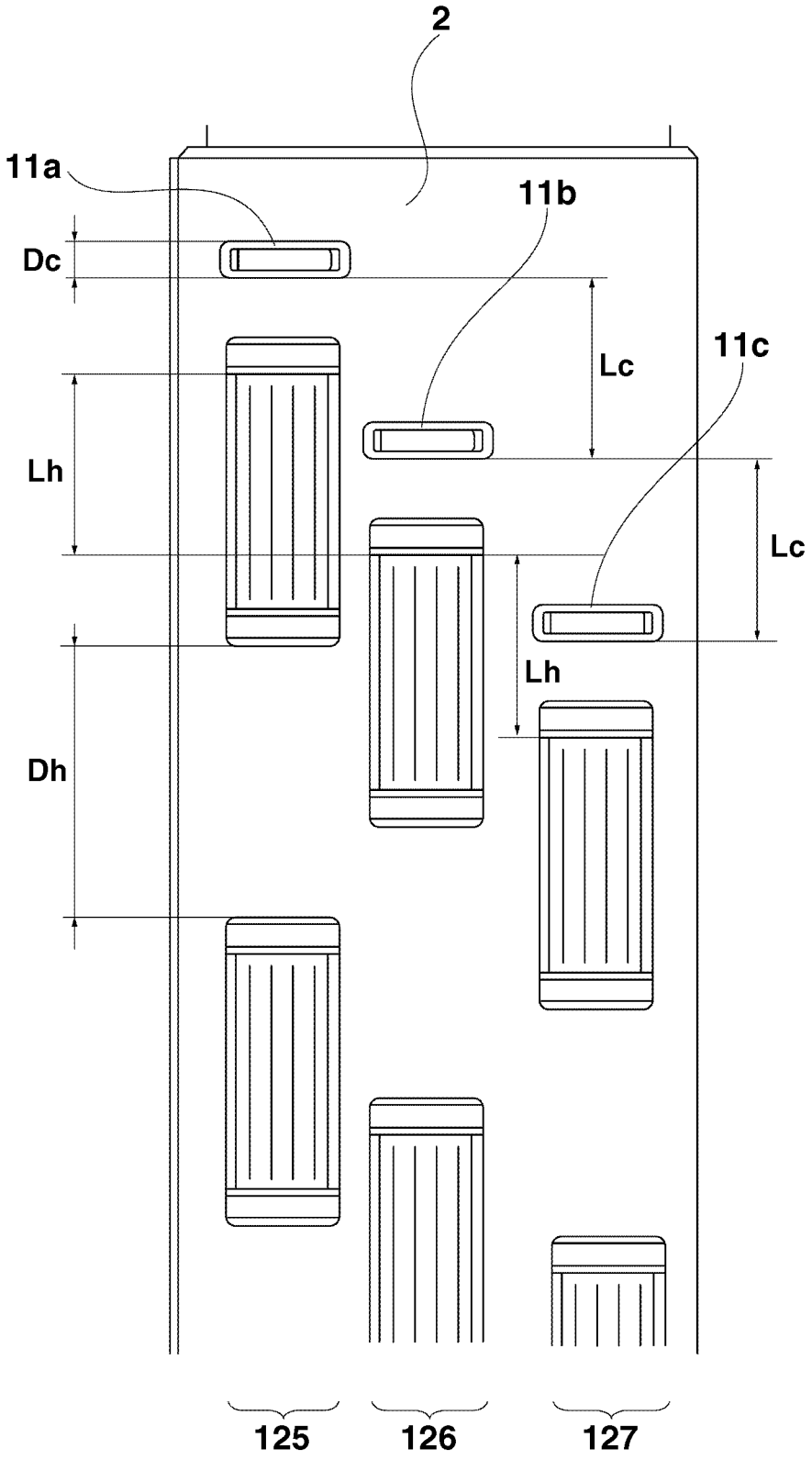
FIG. 13 illustrates another example of the nozzle chip arrangement.

FIG. 13 show another example of the arrangement of the nozzle chips. Three nozzle chip arrays of a first nozzle chip array 125, a second nozzle chip array 126, and a third nozzle chip array 127 are arranged in a regular fashion. Corresponding to these nozzle chip arrays, there are arranged three suction ports of a first suction port 11*a*, a second suction port 11*b*, and a third suction port 11*c* are arranged so as to be opposed thereto. In the second direction, the distance (shift amount) between the first suction port 11*a* and the second suction port 11*b*, the distance between the second suction port 11*b* and the third suction port 11*c*, and the distance between the third suction port 11*c* and the first suction port 11*a* are all Lc. In the second direction, the distance (shift amount) between the adjacent nozzle chips of the first array and the second array, the distance between the adjacent nozzle chips of the second array and the third array, and the distance between the adjacent nozzle chips of the third array and the first array are all Lh. As in the exemplary embodiment of FIG. 6, Lc and Lh are equal to each other (which means, as described above, the case in which they are substantially equal to each other is also covered). Further, the relationship Dc<Dh is satisfied. Thus, while the first suction port 11*a*, the second suction port 11*b*, and the third suction port 11*b* are performing nozzle suction, there is no danger that the suction holder 12 is inclined or pushed in to make the suction unstable, thus achieving an improvement in terms of nozzle cleaning reliability. In this way, when two of the plurality of arrays are taken, the first suction unit and the second suction unit are shifted from each other in the second direction in correspondence with the shift in the second direction between the adjacent first nozzle chips and second nozzle chips of the different arrays.

While, in the above exemplary embodiment, the wiper unit 46 moves with respect to the stationary recording head 2, it is not limited thereto. It is also possible to adopt a system in which the recording head moves with respect to the wiper unit to perform cleaning. That is, the present invention is applicable to a recording apparatus having an ink suction unit opposed to a part of the nozzles of the nozzle arrays of a recording head and adapted to make a relative movement in the direction in which the nozzle arrays are formed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-262072 filed Nov. 17, 2009, which is hereby incorporated by reference herein in its entirety.

What is claimed is:

1. An apparatus comprising:

a convey mechanism configured to convey a sheet in a first direction;

a recording head configured to perform recording by discharging ink on the sheet, the recording head including a base board having a first nozzle chip group in which a plurality of first nozzle chips, in each of which a plurality of nozzles is arranged in a second direction crossing the first direction, is provided in the second direction, a second nozzle chip group in which a plurality of second nozzle chips, in each of which a plurality of nozzles is arranged in the second direction, is provided in the second direction, and a plurality of first and second sealing portions, the plurality of first sealing portions provided in end portions of the plurality of first nozzle chips in the second direction, and the plurality of second sealing portions provided in end portions of the plurality of second nozzle chips in the second direction, each of the plurality of first and second sealing portions protruding from the base board, wherein the first nozzle chip group and the second nozzle chip group are arranged so as to be shifted from each other in the first direction, and wherein a first nozzle chip and a second nozzle chip which are adjacent to each other, the first nozzle chip being from the first nozzle chip croup and the second nozzle chip being from the second nozzle chip group, are shifted from each other in the second direction;

a suction holder including a first suction unit configured to suck ink from the plurality of first nozzle chips and a second suction unit configured to suck ink from the plurality of second nozzle chips, wherein the first suction unit and the second suction unit are shifted from each other in the second direction by an amount that corresponds to the shift between the first nozzle chip and the second nozzle chip; and an urging member configured to urge the suction holder in such a manner that the first suction unit and the second suction unit are in contact with the base board;

wherein the suction holder moves in the second direction in a state where the first suction unit and the second suction unit are urged to the base board, and in moving in the second direction, the first suction unit and the second suction unit abut the first and second sealing portions, respectively, simultaneously, such configuration allowing the first suction unit and the second suction unit to perform suctioning of the nozzles across which they move as they move in the second direction, even where the sealing portions protrude over a surface height of the nozzles.

2. The apparatus according to claim 1, wherein, in the second direction, the shift distance between the first nozzle chips and the second nozzle chips adjacent to each other and the shift distance between the first suction unit and the second suction unit are equal to each other.

3. The apparatus according to claim 1, wherein the first suction unit has a first suction port in proximity to the first nozzle chips, and the second suction unit has a second suction port in proximity to the second nozzle chips, wherein a negative pressure for suctioning ink from the nozzle arrays is applied to each of the first suction port and the second suction port.

4. The apparatus according to claim 3, wherein the suction holder is supported by a displacement mechanism having an elastic member so as to allow both a straight-ahead displacement in the direction of the distance between a nozzle surface of the recording head and a sheet, and a tilt displacement around a rotation axis in the first direction with respect to the nozzle surface.

5. The apparatus according to claim 3, wherein the suction holder is supported by a displacement mechanism having an elastic member so as to allow a tilt displacement around a rotation axis in the first direction with respect to a nozzle surface of the recording head.

6. The apparatus according to claim 3, wherein the relationship $Dc<Dh$ is satisfied, wherein a width in the second direction of the first suction port or the second suction port is Dc, and the distance in the second direction between the adjacent nozzle chips of the same array is Dh.

7. The apparatus according to claim 1, wherein the suction force of the first suction unit and the suction force of the second suction unit differs between a forward movement and a backward movement by the movement mechanism.

8. The apparatus according to claim 1, wherein the movement speed of the movement mechanism differs between a forward movement and a backward movement by the movement mechanism.

9. The apparatus according to claim 1, wherein the first suction unit has a first ink absorbing member abutting the first nozzle chips and configured to suction ink from a part of the nozzles, and the second suction unit has a second ink absorbing member abutting the second nozzle chips and configured to suction ink from a part of the nozzles.

10. The apparatus according to claim 1, further comprising:

a first blade for wiping nozzle surfaces of the first nozzle chips, and a second blade for wiping nozzle surfaces of the second nozzle chips, wherein the first blade and the second blade are caused to make a relative movement along the second direction between themselves and the recording head by the movement mechanism.

11. The apparatus according to claim 10, further comprising a blade holder retaining the first blade and the second blade, and a mechanism configured to switch the blade holder between a wiping position and a retracted position.

12. The apparatus according to claim 11, wherein the blade holder and the suction holder are arranged on a common support member, and a portion of the first suction unit or the second suction unit nearest to the nozzle surface is positioned between a forward end portion of the first blade or the second blade in the wiping position and the forward end portion in the retracted position, in a third direction which is perpendicular to the first direction and the second direction.

13. The apparatus according to claim 1, wherein sealing portion is formed in the vicinity of an end portion in the second direction of each of the first nozzle chips and of the second nozzle chips, and the sealing portion is higher than the nozzle surface with respect to the direction in which ink is ejected.

14. The apparatus according to claim 1, wherein a part of the nozzles in the first nozzle chip and a part of the nozzles in the second nozzle chip adjacent to the first nozzle chip overlap each other in the second direction.

* * * * *